US008025281B2

(12) United States Patent
Shimizu et al.

(10) Patent No.: US 8,025,281 B2
(45) Date of Patent: Sep. 27, 2011

(54) SHEET POST-FINISHING APPARATUS AND IMAGE FORMING APPARATUS USING THE SAME

(75) Inventors: Satoru Shimizu, Hachioji (JP); Tsuyoshi Mizubata, Hachioji (JP); Zen Kayaba, Hino (JP)

(73) Assignee: Konica Minolta Business Technologies Inc., Tokyo (JP)

( * ) Notice: Subject to any disclaimer, the term of this patent is extended or adjusted under 35 U.S.C. 154(b) by 234 days.

(21) Appl. No.: 12/423,252

(22) Filed: Apr. 14, 2009

(65) Prior Publication Data

US 2009/0261523 A1 Oct. 22, 2009

(30) Foreign Application Priority Data

Apr. 18, 2008 (JP) ..... 2008-108810

(51) Int. Cl.
*B65H 37/04* (2006.01)

(52) U.S. Cl. ..... 270/58.09; 270/58.07; 270/58.08

(58) Field of Classification Search ..... 270/37, 270/58.07, 58.08, 58.09, 58.11
See application file for complete search history.

(56) References Cited

U.S. PATENT DOCUMENTS

| | | | | |
|---|---|---|---|---|
| 6,220,592 | B1 * | 4/2001 | Watanabe et al. | 271/241 |
| 7,654,511 | B2 * | 2/2010 | Nagata et al. | 270/58.11 |
| 7,681,873 | B2 * | 3/2010 | Tsutsui et al. | 270/58.08 |
| 2006/0202403 | A1 * | 9/2006 | Nagata et al. | 270/58.11 |
| 2007/0138730 | A1 * | 6/2007 | Tsutsui et al. | 270/58.09 |
| 2007/0145661 | A1 | 6/2007 | Ichikawa | |

FOREIGN PATENT DOCUMENTS

| | | | |
|---|---|---|---|
| JP | 06-211414 | A | 8/1994 |
| JP | 8-192951 | A | 7/1996 |
| JP | 10-218475 | A | 8/1998 |
| JP | 2001-316028 | A | 11/2001 |
| JP | 2003-334803 | A | 11/2003 |
| JP | 2007-176677 | A | 7/2007 |

OTHER PUBLICATIONS

Japanese Office Action dated Jan. 19, 2010 and English translation thereof in counterpart Japanese Application No. 2008-108810.

* cited by examiner

*Primary Examiner* — Leslie A Nicholson, III
(74) *Attorney, Agent, or Firm* — Holtz, Holtz, Goodman & Chick, PC

(57) ABSTRACT

In a sheet post-finishing apparatus, a stapling device conducts a saddle stitching process on a bundle of sheets, based on an instruction signal; a sheet guide member, mounted on the stapling device, faces a surface of a sheet to be stacked on a sheet stacking section; a stapling device moving section allows the stapling device to move along a line dividing the sheet into two equal portions, perpendicular to a sheet conveyance direction; and a control section controls the stapling device to stand by above a lateral center of the sheet to be conveyed to the stapling device, while the sheets are stacked as the bundle of sheets, and after the bundle of sheets is formed, the control section controls the stapling device to sequentially move to predetermined plural positions, whereby said control section sends the instruction signal to the stapling device which was stopped at the predetermined positions.

8 Claims, 6 Drawing Sheets

SHEET POST-FINISHING APPARATUS AND IMAGE FORMING APPARATUS USING THE SAME

CROSS REFERENCE TO RELATED APPLICATION

This application is based on Japanese Patent Application No. 2008-108,810 filed on Apr. 18, 2008, with the Japanese Patent Office, the entire content of which is hereby incorporated by reference.

TECHNICAL FIELD

The present invention relates to a post-finishing apparatus which stacks sheets sent from an image forming apparatus to form a bundle of sheets, and which conducts a saddle stitching process onto the bundle of sheets, and relates to an image forming system in which the image forming apparatus and the sheet post-finishing apparatus are combined.

BACKGROUND OF THE INVENTION

Sheet post-finishing apparatuses are extensively used, which stack the sheets sent from the image forming apparatus to form bundle of sheets, and which conducts a saddle stitching process onto the bundle of sheets to generate a booklet.

Among various technologies having been applied onto the stitching process, most well-known is a technology to stitch the bundle of sheets by a stapling device.

A saddle stitching process represents a process to stitch the bundle of sheets with staples at a predetermined central position in the long direction of the bundle of sheets where each sheet is to be divided into two equal portions.

The sheet post-finishing apparatuses to conduct said saddle stitching process are mostly premised to be combined to the image forming apparatus, and used as an image forming system (See Unexamined Japanese Patent Application Publication No. H8-192,951).

The stapling device used in the saddle stitching process cannot be placed at the edge portion of the sheets to be stacked, though the stapling device used in a stitching process to staple the edge portion of the sheets can be placed.

Accordingly, the stapling device is configured in such a way that before the bundle of sheets is formed, the stapling device stays away to a position where the stapling device does not interfere with the sheet stacking operation, such as a position at the edge of the sheets to be stacked along the long edge, and after the bundle of sheets has been formed, the stapling device returns to its functional position, and conducts the stapling operation.

In order to conduct a correct stitching process, the leading portion and both end portions of the bundle of sheets stacked on a sheet stacking section must be neatly aligned.

However, as described above, since the stapling device is configured to move along the surface of the bundle of sheets, it is very difficult to provide guide members to restrict both surfaces of the sheet being conveyed toward the sheet stacking device, at the desired position.

Specifically, in case of a stapling process in which a single stapling device is sequentially moved to staple the bundle of sheets at plural portions (see Unexamined Japanese Patent Application Publication No. 2003-334,803), the stapling device moves over a large area, so that the guide member is barely provided at the desired position.

As a result, the sheet is unstably conveyed into the sheet stacking section, whereby the edges of the sheets being stacked on the sheet stacking section are not properly aligned, which is an adverse matter.

Accordingly, a guide member, to restrict both surfaces of the sheet being conveyed into the sheet stacking section, is necessarily provided to face a center surface of the sheet. When said stapling device is moved, a driving mechanism is necessarily provided to move said guide member, so that the movement of the stapling member is not disturbed.

However such a driving mechanism may result in a price increase of the apparatus.

SUMMARY OF THE INVENTION

Aspects of the present invention are listed below.

1. A sheet post-finishing apparatus which stacks sheets, conveyed from an image forming apparatus, on a sheet stacking section to form a bundle of sheets, and conducts a saddle stitching process on the formed bundle of sheets, including:

a stapling device to conduct a stitching process, when the stapling device receives an instruction signal to instruct an execution of the stitching process;

a sheet guide member which is mounted on the sheet stapling device, and faces a surface of the sheet to be stacked on the sheet stacking section;

a stapling device moving section which allows the stapling device to move along a line dividing the sheet into two equal portions, perpendicular to a sheet conveyance direction; and a control section which controls the stapling device to stand by above a lateral center portion of the sheets to be conveyed to the stapling device, while the sheets are stacked to be formed as the bundle of sheets, and said control section controls the stapling device to sequentially move to predetermined plural positions, after the bundle of sheets has been formed, after that, said control section sends the instruction signal to the stapling device which was stopped at the predetermined plural positions.

2. An image forming system in which the sheet post-finishing apparatus of claim 1 is combined with an image forming apparatus.

BRIEF DESCRIPTION OF THE DRAWINGS

Embodiment will now be described, by way of example only, with reference to the accompanying drawings which are meant to be exemplary, not limiting, and wherein like elements are numbered alike in the several figures, in which.

DETAILED DESCRIPTION OF THE PREFERRED EMBODIMENT

Figure 1:
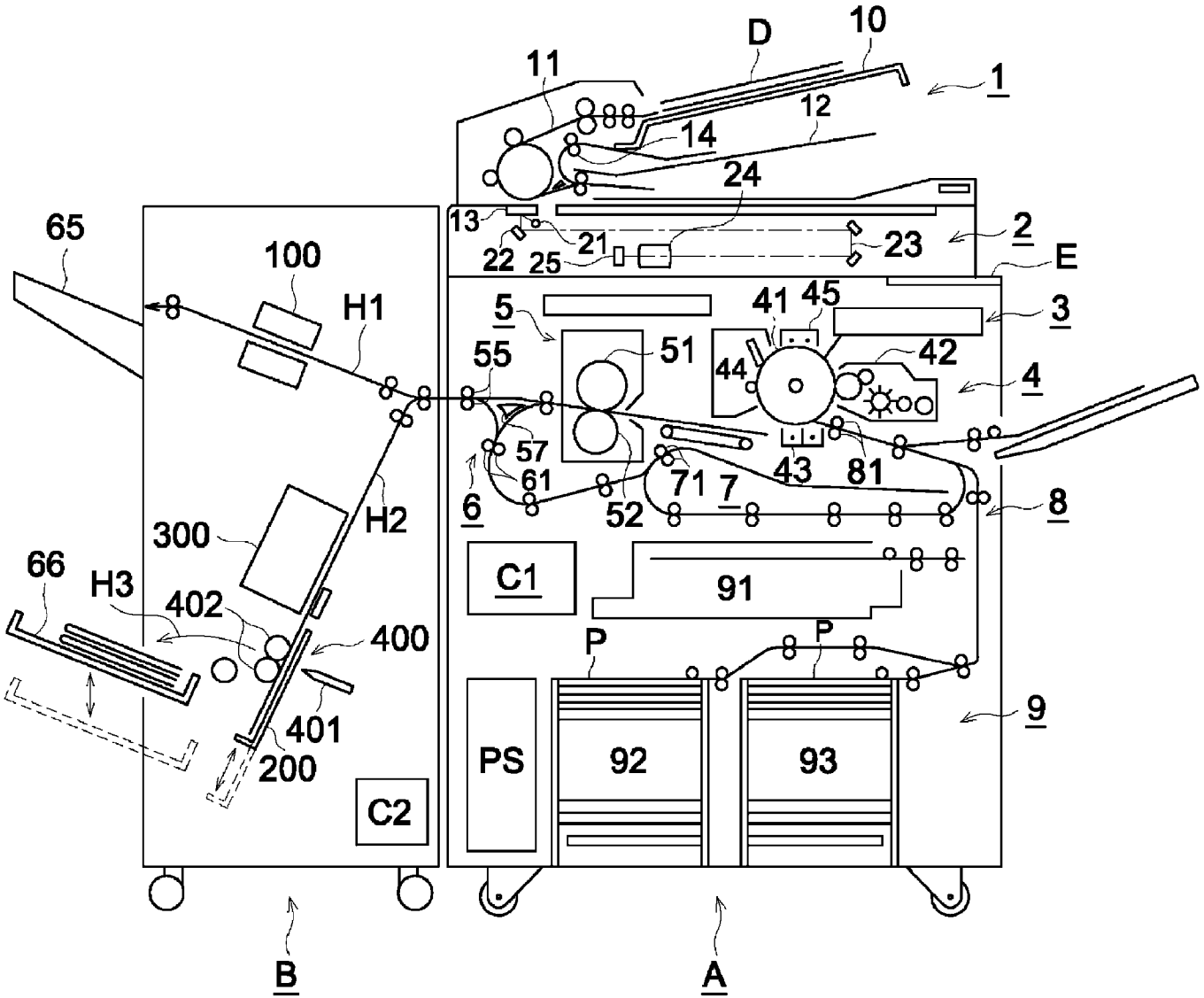
FIG. 1 is an overall schematic drawing of the image forming system.

The embodiment of the present invention will now be detailed, while referring to the drawings.

FIG. 1 is a schematic drawing of the image forming system. Said image forming system represents a system in which image forming apparatus A and sheet post-finishing apparatus B are combined.

Image forming system A represents a digital copy machine to form an image by the well-known electro-photographic technology.

Image forming apparatus A includes automatic document feeding device 1, document reading section 2, writing section 3, image forming section 4, image fixing section 5, reversed sheet ejection section 6, sheet re-supplying section 7, sheet conveyance section 8, sheet supplying section 9, control section C1, and operation display section E.

By automatic document feeding device 1, original document D, placed on document platen 10, is fed to document conveyance route 11 one by one, and ejected onto document ejection tray 12.

While document D is fed, an image carried on a surface of document D is read by reading section 2 at document reading position 13.

When the images, carried on both surfaces of document D, are to be read, after the image on the front surface is read, document D is reversed by document reversing section 14, after that, document D is fed into document conveyance route 11 again, whereby the image on the reverse surface is read, and document D is ejected onto document ejection tray 12.

Document reading section 2 includes light source 21, first mirror unit 22, second mirror unit 23, focusing lens 24, and CCD 25.

Said document reading section 2 represents a section in which, while document D runs through image reading position 13, the image carried on document D is scanned, and the image obtained via scanning is focused onto CCD 25, so that document image information, being optical information, is transformed into electronic information.

Said document image information as electric information is further processed with respect to A/D conversion, shading correction, image compression, and is then stored in memory section M1 of control section C1.

Writing section 3 represents an optical scanning system, including a laser light source, a cylindrical lens, an Fθ lens, reflection mirrors, and a polygonal mirror.

By laser beams, which change based on image information read from memory section M1, the surface of photoconductor 41 of image forming section 4 is scanned, whereby a latent image is formed on the surface of photoconductor 41.

Image forming section 4 converts the latent image, formed on the surface of photoconductor 41, to be a visible toner image by development section 42.

Said toner image is transferred onto sheet P, fed by paired registration rollers 81, via transfer section 43.

After the transferring operation, any toner particles, remaining on the surface of photoconductor 41, are removed by cleaning section 44, and the surface is electrically charged by charging section 45, to await the subsequent image formation.

In image fixing section 5, sheet P, carrying the toner image, is heated and pressed by heating roller 51 and pressure applying roller 52, whereby the toner image is permanently fixed on sheet P.

After that, sheet P is fed to sheet post-finishing apparatus B by paired sheet ejection rollers 55.

When reversed sheet P is to be ejected, sheet P is guided downward by sheet ejection guide 57, after which the trailing edge of sheet P is nipped by paired reversing rollers 61 of the sheet reversing section, and sheet P is then conveyed to paired sheet ejection rollers 55 by the reversing rotation of paired reversing rollers 61.

When a double-surface printing operation is to be conducted, after sheet P is conveyed to sheet re-supplying section 7 by sheet ejection guide 57 and plural sets of rollers, sheet P is reversed by reversing roller 71 of sheet re-supplying section 7, after that, sheet P is again conveyed to sheet conveyance section 8.

Sheet conveyance section 8 conveys sheet P, having been conveyed from sheet supplying section 9, by plural rollers and guide members, so that the leading edge of sheet P nudges against paired registration rollers 81. After that, said paired registration rollers 81 rotate to convey sheet P toward photoconductor 41, on which sheet P receives the toner image.

Sheet supplying section 9 is structured of plural sheet trays, which represent first sheet supplying section 91, second sheet supplying section 92, and third sheet supplying section 93.

Sheets P, stored in each sheet supplying section, are sequentially conveyed to sheet conveyance section 8.

Operation display section E1 representing a touch panel, mounted on a top surface of image forming apparatus A, functions to display and allows input of various information, such as the number of sheets P on which the document image is to be printed, and a job which instructs whether the post-finishing operation is to be conducted on the outputted sheets P.

Information, inputted via operation display section E, is sent to control section C1, and stored in memory section M1 of control section C1.

Sheet post-finishing apparatus B of the present invention conducts an instructed saddle stitching process onto sheet P, conveyed from image forming apparatus A.

Sheet post-finishing apparatus B includes three conveyance routes, which represent first conveyance route H1, second conveyance route H2, and third conveyance route H3. Each conveyance route includes plural guide members (which are not illustrated), and plural rollers (some of them are also not illustrated).

First conveyance route H1 conveys sheet P, conveyed from image forming apparatus A, to sheet ejection tray 65.

Hole punching device 100, mounted about the middle of first conveyance route H1, conducts the hole punching operation on sheet P, due to the instructions set on operation display section E.

Second conveyance route H2 conveys sheet P, conveyed from image forming apparatus A, to sheet stacking section 200.

Sheet stacking section 200 arranges the leading edge and side edge of sheet P, conveyed from image forming apparatus A, and sequentially stacks said sheets P to form a bundle of sheets.

Stapling device 300 conducts the stitching operation on the bundle of sheets, along a line on which sheet P is to be divided into two equal portions, perpendicular to the sheet conveyance direction.

After stapling device 300 has conducted the stapling operation on the bundle of sheets, sheet stacking section 200 is lowered, so that the stitched line comes to be equal to a top of folding member 401 of center folding device 400, which is shown by the dashed lines in FIG. 1.

Center folding device 400 works in such a way that after the center portion of the stapled bundle of sheets is inserted between paired folding rollers 402 by folding member 401, the inserted bundle of sheets is center-folded, and then driven to third conveyance route H3 by paired folding rollers 402.

Third conveyance route H3 conveys said center-folded bundle of sheets onto booklet stacking tray 66.

The stapled and center-folded bundle of sheets, that is, a booklet produced by the center stapling process is sequentially stacked on said booklet stacking tray 66.

Figure 2:
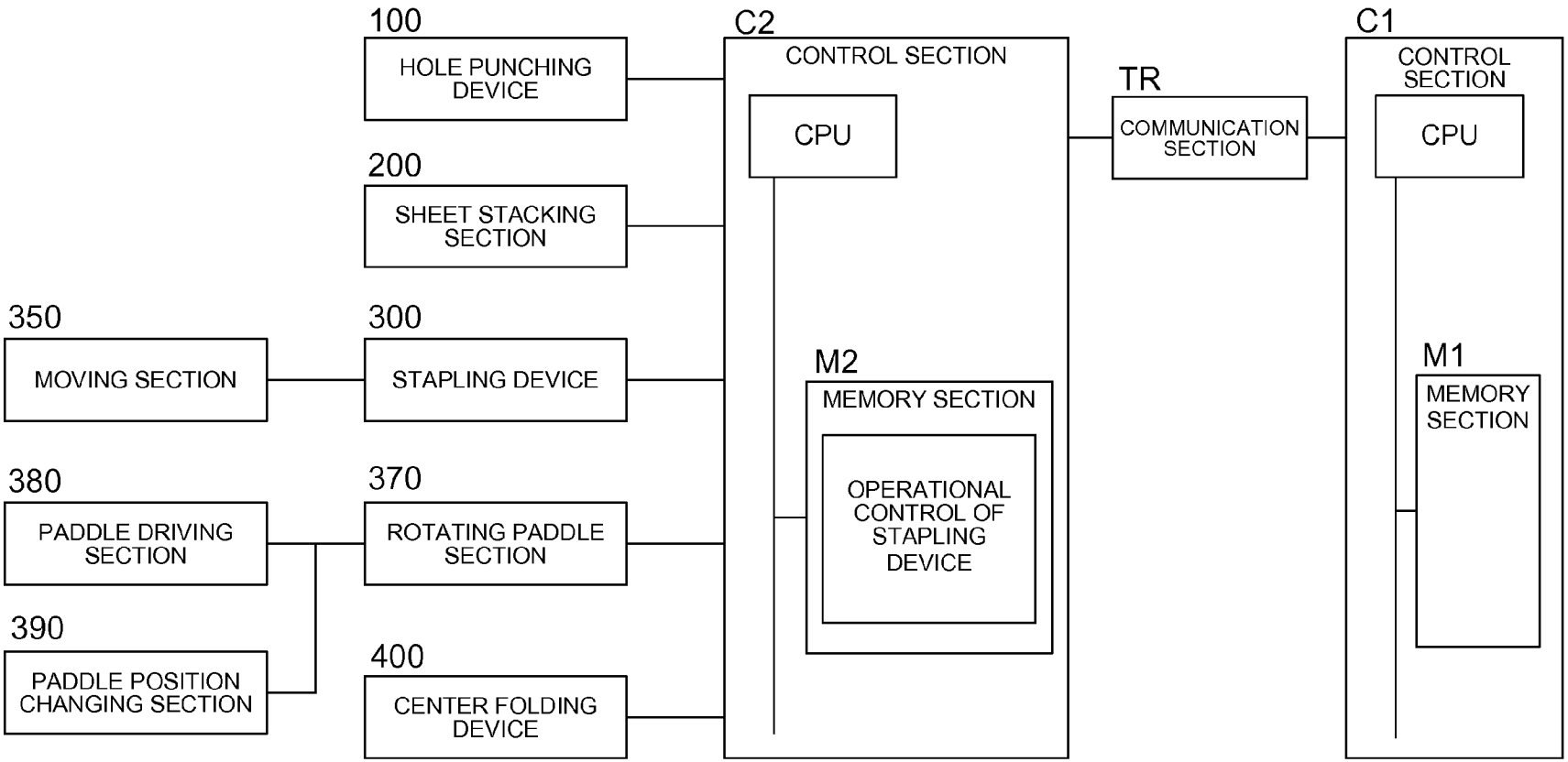
FIG. 2 is a block diagram to show the control-flow of the image forming system.

FIG. 2 is a block diagram to show the control-flow of the image forming system.

Control section C1 of image forming apparatus A and control section C1 of sheet post-finishing apparatus B are computer systems, each having CPU, a calculation unit, a memory section, an input-output interface section, a communicating section, and a driving circuit.

Image forming apparatus A and sheet post-finishing apparatus B are controlled by the programs stored in each of its memory section. FIG. 2 does not show operational blocks which are not necessary for the explanation of the present embodiments.

Control section C1 and control section C2 mutually exchange operational information through communicating section TR.

The various jobs to be used in the image forming system can be set via operation display section E of image forming apparatus A, and information processing devices (which are not illustrated) connected to image forming apparatus A via communication lines.

Figure 3:
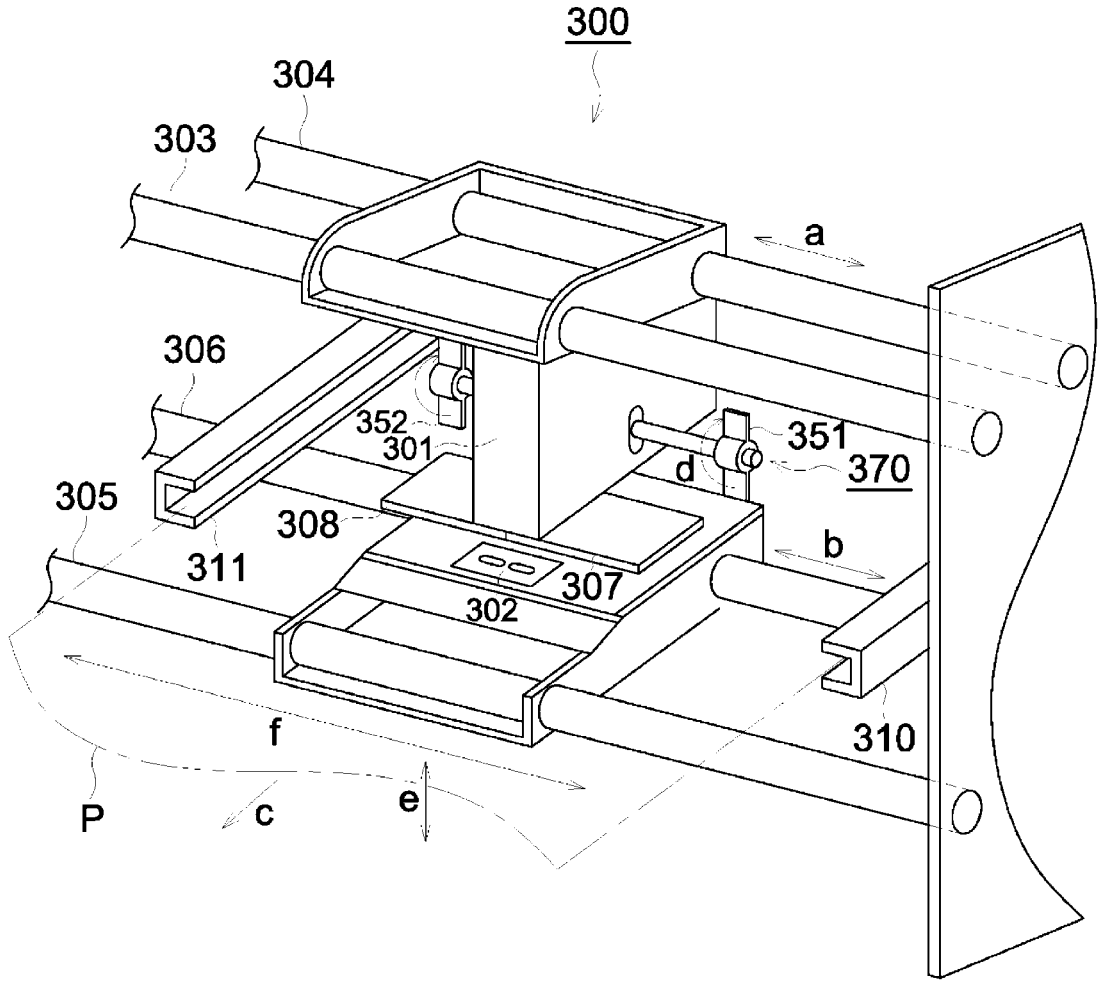
FIG. 3 is a schematic drawing of the stapling device.

FIG. 3 is a schematic drawing of stapling device 300.

Stapling device 300 stitches the bundle of sheets with the staples.

Stapling device 300 includes stitching section 301 to push out the accommodated staples one by one, and staple clinching section 302 to fold the top of each staple having penetrated through the bundle of sheets.

After sheets P are conveyed into a clearance formed between stitching section 301 and staple clinching section 302, in arrowed direction "c", sheets P are formed to be a bundle of sheets.

Though stitching section 301 serving as an upper section is not integrated with staple clinching section 302 serving as a lower section, they maintain their positional relationship between the upper section and the lower section, and move horizontally in arrowed directions "a" and "b", while sliding on parallel guide members 303, 304, 305 and 306.

Under a portion, which faces sheet P, of stitching section 301, some mechanical members exist which could interrupt sheet P while sheet P is conveyed, and which could adversely create sheet jamming or scratch the surface of sheet P.

In order to prevent these potential problems from occurring, sheet guides 307 and 308 are provided on stitching section 301, which guide sheet P, and effectively prevent the surface of sheet P from directly touching the mechanical members of staple clinching section 302.

Sheet guide members 307 and 308 are integrated as a single unit, or they may be separated from each other, both are usable in this embodiment. However, it is necessary that guide members 307 and 308 are structured to be symmetrical with respect to a lateral center line of sheet P to be conveyed.

The reason for said symmetrical structure to be applied, is that, since stapling device 300 is mounted above the lateral center of sheet P, which is fed while guided by width regulation members 310 and 311, sheet P tends to displace slightly in sheet width direction "f", due to the contact with sheet guide members 307 and 308, so that said slight displacement in arrowed direction "f" is more likely to be controlled by the symmetrical structure.

On a base section (which is not illustrated) of stitching section 301 of stapling device 300 of the present invention, rotating paddle section 370 is mounted to convey sheet P by rotating paddles 351 and 352, and moves simultaneously with stapling device 300.

Rotating paddle section 370 is a means to convey sheet P in direction "c", via contact of rotating paddles 351 and 352 with the surface of sheet P, guided by width regulation members 310 and 311.

Rotating paddle section 370 is structured of paddles 351 and 352, formed of an elastic material, paddle driving section 380 (which is not illustrated) to rotate said paddles 351 and 352 in direction "d", and paddle position changing section 390 (which is not illustrated in FIG. 3, but illustrated in FIG. 7) to change the distance between sheet P, and paddles 351 and 352.

Paddles 351 and 352 are structured to be symmetrical with respect to the lateral center line of sheet P, which is the same structure as the case of sheet guide members 307 and 308.

Figure 4:
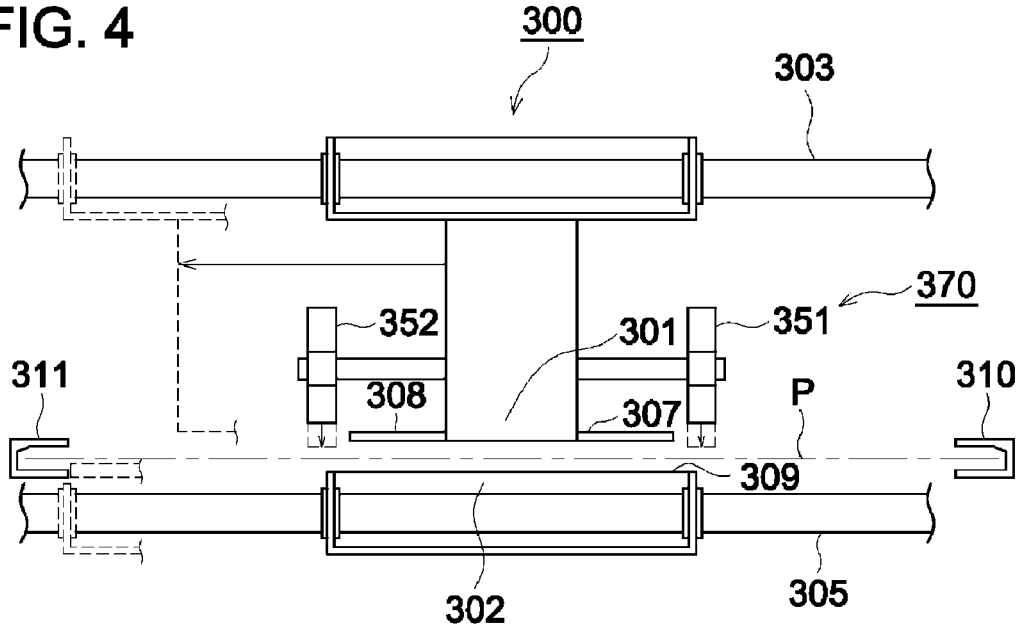
FIG. 4 shows the positional relationship between the stapling device, the sheet guide member, a rotating paddle, and the sheet.

FIG. 4 shows the positional relationship between stapling device 300, sheet guide members 307 and 308, rotating paddle section 370, and sheet P.

Stitching section 301 and staple clinching section 302, both of which structure stapling device 300, must maintain their mutual positional relationship, and move along guide members 303 and 304, and guide members 305 and 306, respectively.

Sheet P, shown by chain lines in FIG. 3, is conveyed in arrowed direction "c", while both edges of sheet P are regulated by width regulation members 310 and 311 in width direction "f", and both surfaces of sheet P are vertically regulated in direction "e" by sheet guide members 307 and 308 of stitching section 301, and guide member 309 of staple clinching section 302 (See FIG. 4).

While sheet P is being fed, stapling device 300 remains centered between width regulation members 310 and 311.

Further, if there is no job to conduct the stitching process, or when the image forming apparatus is in a standby mode, stapling device 300 stays near either width regulation member 310 or 311.

When sheet P passes through stapling device 300, rotating paddles 351 and 352 move toward sheet P to come into contact with the surface of sheet P, whereby sheet P is further conveyed to a sheet stopping member (which is not illustrated), which is mounted on sheet stacking section 200.

Figure 5:
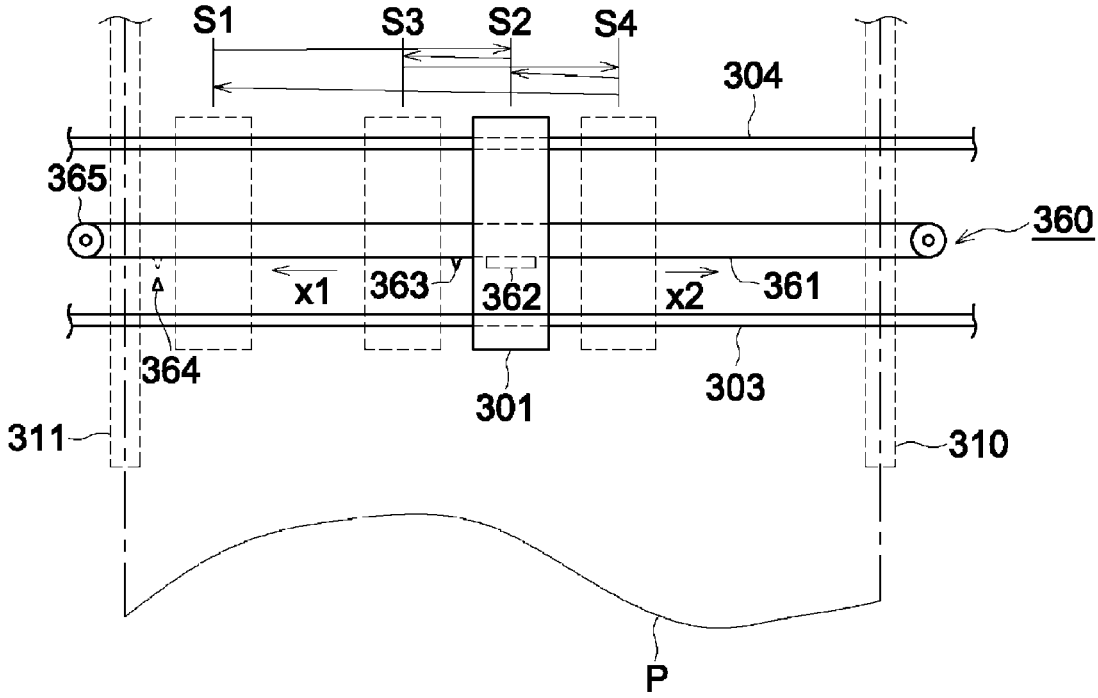
FIG. 5 shows the moving section of the stapling device.

FIG. 5 shows stitching section moving section 360 of stapling device 300.

A portion of timing belt 361 of moving section 360, to move stitching section 301, is firmly secured by fixing member 362, onto stitching section 301 of stapling device 300, which moves while guided by guide members 303 and 304.

Detection mark 363, to indicate the position of stapling device 300, is mounted near said fixing member 362 on timing belt 361. Said detection mark 363 is detected by position detecting sensor 364.

Timing belt 361 is driven by a stepping motor (which is not illustrated) through pulley 365.

When timing belt 361 rotates in arrowed direction x1, stitching section 301 also moves in arrowed direction x1.

After position detecting sensor 364 detects detection mark 363, control section C2 receives a detection signal from position detecting sensor 364, and control section C2 controls the stepping motor to further rotate a predetermined number of steps, and controls it to stop, at which point, the stepping motor is deactivated.

Staple clinching section 302, facing stitching section 301, moves along guide members 305 and 306, with stitching section 301, by the same structure.

The position, at which stapling device 300 stays by the deactivated stepping motor, is referred to as "the home position" in the present application (represented by S1 in FIG. 5).

When the job to conduct the stitching process is started, timing belt 361 moves in arrowed direction x2, whereby, detection mark 363, mounted on timing belt 361, is detected by position detecting sensor 364.

After control section C2 receives the detection signal from position detecting sensor 364, control section C2 controls the stepping motor to rotate a predetermined number of steps, whereby stapling device 300 moves in direction x2, and stops at lateral center S2 of advancing sheet P, shown in FIG. 5.

That is, stapling device 300 stops at the lateral center of sheet P, and immovably stays at the stopped position, by the stepping motor, having been activated.

To conduct the stitching process on the bundle of sheets, control section C2 controls stapling device 300, which has been stopped at center position S2, to move to and stop at first stitching position S3. Control section C2 then sends a signal to conduct the stitching process to stapling device 300, after which, the stitching process is conducted at first stitching position S3 of the bundle of sheets.

After that, control section C2 controls stapling device 300 to move to and stop at second stitching position S4, the next stitching process is conducted at second stitching position S4 of the bundle of sheets.

If the successive bundle of sheets, on which the stitching process is to be conducted, are continuously fed, a procedure is continued so that after stapling device 300 has conducted the stitching process at two positions on the bundle of sheet, stapling device 300 is again returned to center position S2, and when the job to conduct the stapling process is completed, stapling device 300 is returned to home position S1.

Figure 6:
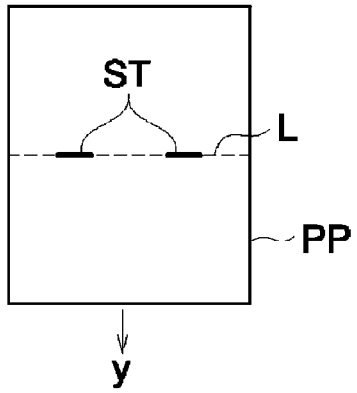
FIGS. 6(*a*) and 6(*b*) show the bundle of sheets on which the stapling process has been conducted.
Figure 6:
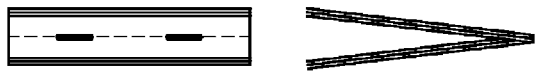

FIGS. 6(*a*) and 6(*b*) show a bundle of sheets on which the stitching process has been conducted.

As shown in FIG. 6(*a*), bundle of sheets PP is stapled at positions ST by stapling device 300, wherein stapling device 300 moves along dotted line L shown in FIG. 6(*a*). Line L is perpendicular to sheet conveyance direction "y", and divides sheet P into two equal portions at the center of sheet P with respect to the sheet feeding direction.

FIG. 6(*b*) shows the shape of bundle of sheets PP which has been folded after the saddle stitching process.

Figure 7:
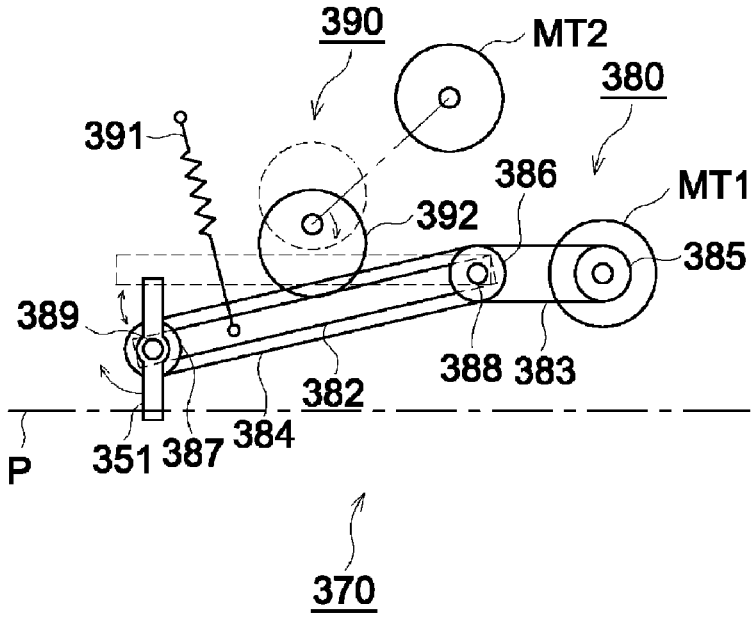
FIG. 7 is a schematic drawing of the paddle rotation section.

FIG. 7 is a schematic drawing of rotating paddle section 370.

As detailed above, rotating paddle section 370 is structured of paddle driving section 380, and paddle position changing section 390 to change the distance between sheet P and paddles 351 and 352.

Paddle driving section 380 is structured of lever 382, endless belts 383, and 384, belt pulleys 385, 386, and 387, and the like.

Motor MT1, serving as a driving source, enables paddle 351 to rotate, via endless belts 383 and 384, belt pulleys 385, 386, and 387, and rotation shafts 388 and 389.

Rotation shaft 388 at one end of lever 382 is mounted on a portion of the base of stapling device 300. The other end of lever 382, carrying paddles 351 and 352 (paddle 352 is not illustrated in FIG. 7), is pivoted on rotating shaft 388, so that lever 382 can move.

To change the height of lever 382, paddle position changing section 390 continuously changes the distance between paddle 351 and sheet P.

Lever 382 is pulled by spring 391 against eccentric cam 392, being rotated by motor MT2.

Control section C2 controls the rotation of motor MT2 so that eccentric cam 392 rotates to a predetermined angle from a starting position.

Figure 8:
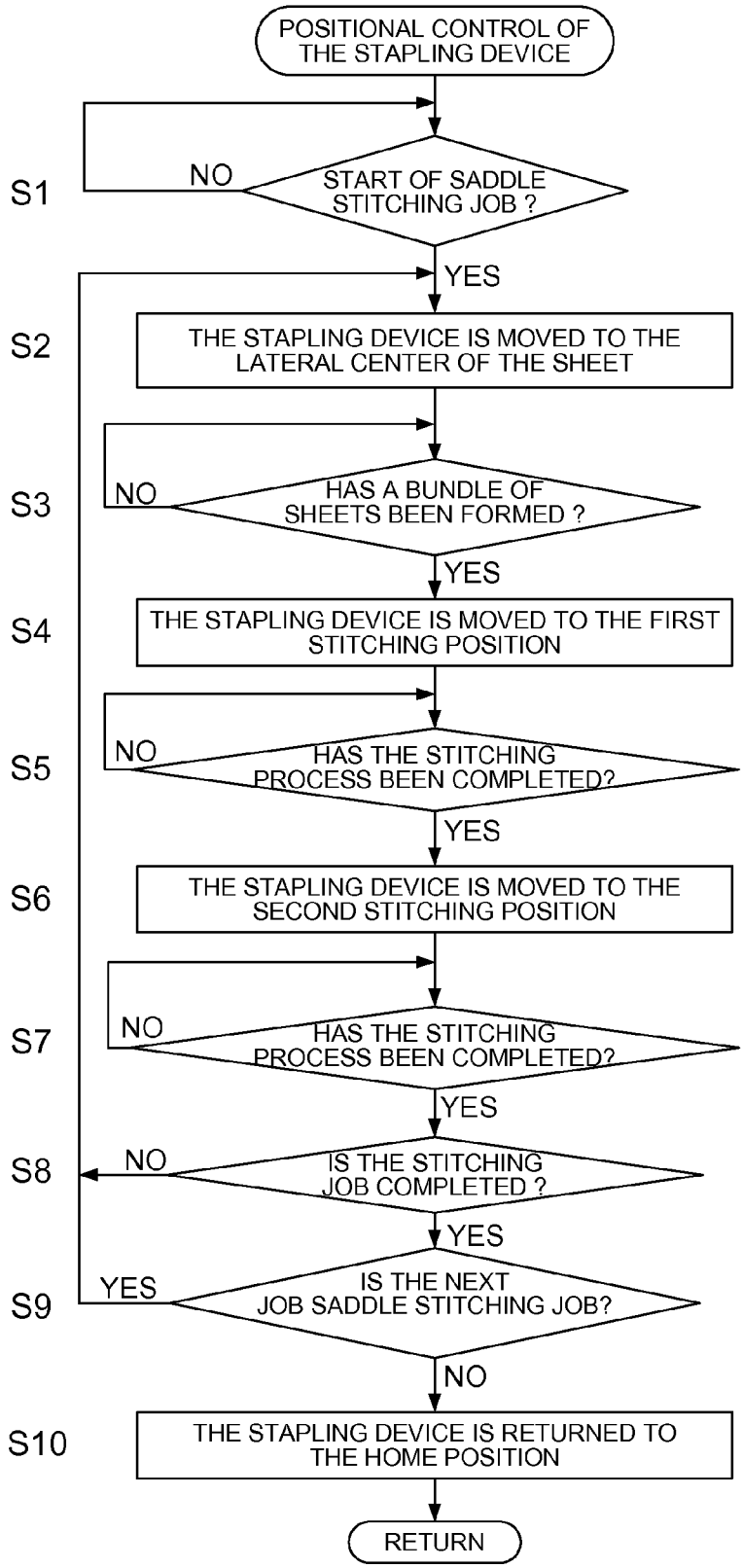
FIG. 8 is a flow chart to show the operational flow of the positional control of the stapling device.

FIG. 8 is a flow chart to show the operational flow of the positional control of stapling device 300.

Control section C2 controls moving section 360 so that the positional control is conducted for stapling device 300.

When information to conduct the job of the saddle stitching process reaches control section C2 of sheet post-finishing apparatus B from control section C1 of image forming apparatus A ("Yes" in step S1), control section C2 allows stapling device 300, standing by at the home position, which is near width regulation member 311 of the conveyance route of sheet P, to move toward lateral center S2 of sheet P being conveyed (step S2).

In addition, the moving distance of stapling device 300 is determined by the number of driving pulses which are applied to the stepping motor, after position detecting sensor 364 detects detection mark 363.

After plural sheets P have been sequentially stacked on sheet stacking section 200 to become a bundle of sheets ("Yes" in step S3), stapling device, having been stopped at lateral center S2 of the sheet P being conveyed, is moved to first stapling position S3, at which the stitching process is conducted (steps S4 and S5).

After the stapling process is completed ("Yes" in step S5), stapling device 300 is moved from first stapling position S3 to second stapling position S4, at which another stapling process is conducted (steps S6 and S7).

If the stapling job is to be continued ("No" in step S8), stapling device 300 is moved from second stapling position S4 back to center position S2 (Step S2).

When the stapling job has been completed, ("Yes" in step S8), control section C2 obtains information from control section C1 (step S9), whether the next job is to conduct the saddle stitching process or not.

If the next job is also a saddle stitching job, stapling device 300 is moved from second stapling position S4 to center position S2 (step S2).

If the next job is not a saddle stitching job, stapling device 300 is moved from second stapling position S4 to home position S1 (step S10), and the control flow goes out of a routine flow.

The above explanation concerns the case in which the stapling device staples the bundle of sheets at two positions. However, the stapling positions and the number of the stapling operations are not limited to two stapling positions and two stapling operations, that is, they can also be a previously determined plural number of said stapling operations.

Based on the present embodiment, the bundle of sheets is prevented from the adverse alignment of the edges which may occur when the bundle of sheets is saddle-stitched, whereby the formed booklet exhibits better alignments on the edges, and the formed booklet is improved in quality.

What is claimed is:

1. A sheet post-finishing apparatus which stacks sheets, sent from an image forming apparatus, on a sheet stacking section to form a bundle of sheets, and conducts a saddle stitching process on the formed bundle of sheets, the sheet post-finishing apparatus comprising:

a stapling device which conducts the saddle stitching process on the bundle of sheets, when the stapling device receives an instruction signal instructing an execution of the saddle stitching process;

a sheet guide member which is mounted on the stapling device, and which faces a surface of a sheet to be stacked on the sheet stacking section;

a stapling device moving section which allows the stapling device to move along a line dividing the sheet into two equal portions, perpendicular to a sheet conveyance direction;

a control section which (i) controls the stapling device to stand by above a lateral center portion of the sheet to be conveyed to the stapling device, while the sheets are stacked to be formed as the bundle of sheets, and after the bundle of sheets has been formed, (ii) controls the stapling device to sequentially move to predetermined plural positions, and therafter, (iii) sends the instruction signal to the stapling device which was stopped at the predetermined plural positions;

paddles which are mounted at both sides of the stapling device and move together with the stapling device, wherein the paddles rotate to convey a sheet while contacting with a surface of the sheet which is guided by the sheet guide member; and a paddle driving section which moves together with the stapling device and rotates the paddles.

2. The sheet post-finishing apparatus of claim 1, wherein the sheet guide member is structured to be symmetrical with respect to a lateral center line of the sheet to be conveyed.

3. An image forming system in which the sheet post-finishing apparatus of claim 2 is combined with an image forming apparatus.

4. The sheet post-finishing apparatus of claim 1, further comprising a paddle position changing section which changes a distance between the paddles and the surface of the sheet to be conveyed.

5. An image forming system in which the sheet post-finishing apparatus of claim 4 is combined with an image forming apparatus.

6. The sheet post-finishing apparatus of claim 1, wherein the control section controls the sheet stapling device moving section to stand by near a lateral edge section of the sheet to be conveyed, while the image forming apparatus stands by, and the control section further controls the sheet stapling device moving section to move toward the lateral center portion of the sheet to be conveyed, before the sheets, to be formed as the bundle of sheets, reach the sheet stacking section.

7. An image forming system in which the sheet post-finishing apparatus of claim 6 is combined with an image forming apparatus.

8. An image forming system in which the sheet post-finishing apparatus of claim 1 is combined with an image forming apparatus.

* * * * *